United States Patent [19]

Kovach

[11] 4,452,122

[45] Jun. 5, 1984

[54] PIANO TUNING MUTES

[76] Inventor: Bruce F. Kovach, 5918 Radnor, Detroit, Mich. 48224

[21] Appl. No.: 432,567

[22] Filed: Dec. 16, 1982

[51] Int. Cl.[3] ..... G10C 9/00

[52] U.S. Cl. ..... 84/458; 84/455

[58] Field of Search ..... 84/453–460

[56] References Cited

U.S. PATENT DOCUMENTS

| | | | |
|---|---|---|---|
| 602,499 | 4/1898 | Dayfoot | 84/454 X |
| 1,428,738 | 9/1922 | Youngman | 84/458 |
| 3,183,761 | 5/1965 | Van Ooyen | 84/455 |
| 3,675,529 | 7/1972 | Van Der Woerd | 84/455 |

*Primary Examiner*—Lawrence R. Franklin

[57] ABSTRACT

A muting strip for use in tuning the un-wound three string unisons of the treble section in pianos consisting of a strip of muting material having on it a series of wedges spaced at a distance from each other so that they will fit into every other space between the unisons. In tuning, two mutes are used with one above the other and offset one unison so that all spaces between the unisons are muted as is normal. After the center string of each unison is tuned one of the mutes is removed and one outer string of each unison is tuned. Then the remaining mute is shifted over one space and the remaining strings are tuned.

2 Claims, 2 Drawing Figures

PIANO TUNING MUTES

FIELD OF INVENTION

This invention relates to the mutes which are used in the tuning of pianos.

DISCUSSION OF PRIOR ART AND SUMMARY

In the past the treble section of pianos has been tuned by using a continuous mute consisting of a strip of felt which is poked inbetween the three string unisons with a screwdriver or like instrument in order to allow the center string of each unison to be tuned. The continuous mute is then removed and the outer strings of each unison are tuned to the center string one at a time using a single wedge mute to mute out the outer string which is not being tuned. The single wedge mute must be relocated many times because there are commonly 120 outer strings to be tuned. In the invention I have designed a muting strip which can be quickly installed without a screwdriver and can be used to tune the outer strings of each unison as well as the center strings thus speeding up the tuning process by eliminating the use of individual wedge mutes in tuning the treble section of the piano.

DRAWINGS

DESCRIPTION AND OPERATION OF THE PREFERRED EMBODIMENT

Figure 1:
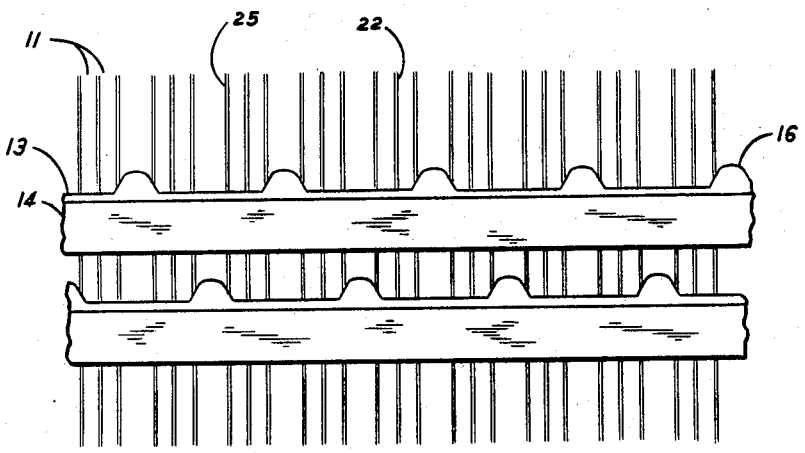
FIG. 1 is a perspective view of the muting strips in use.
Figure 2:
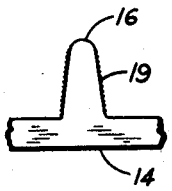
FIG. 2 is a top view of a single wedge.

In the FIG. 1 the three string unisons of the treble section of any piano are indicated by the FIG. 11. A section of the muting strip is indicated by the FIG. 13. The muting strip 13 consists of an elongated rectangular back section 14 and a series of wedges 16. The muting strip 13 should be preferably made of a soft rubber which has poor springing qualities and good damping qualities. Rubber tape which is commonly used for electrical work is an example of a suitable rubber and I have made mutes for myself out of rubber tape which have excellent muting properties and which always stay wedged between the strings even when the strings are struck hard during tuning. The wedges 16 are spaced on the muting strip back section 14 at such a distance from each other that they will fit into every other space between the unisons 11. The wedges 16 may have small ridges 19 on their surface that contacts the outer strings 25 in order to better secure the wedges 16 between the unisons 11. In tuning, two muting strips are used with one above the other and offset one unison so that all spaces between the unisons are muted as is normal and as is shown in FIG. 1. The muting strip 13 is put in place by simply pressing along the muting strip back section 14. After the center string 22 of each unison 11 is tuned, one of the muting strips 13 is removed and one outer string 25 of each unison 11 is tuned. Then the remaining mute is shifted over one space and the remaining strings are tuned. The muting strip 13 may be supplied in extra long length which may be cut to length according to the needs of different pianos and different tuning methods. The primary object of the invention is to save time in tuning by spending less time changing mute positions however I have found that these mutes also provide superior muting of the strings, especially in poorly strung pianos with unevenly spaced strings.

I claim:

1. A muting strip for use in tuning pianos which comprises a strip of muting material having a series of wedges thereon which are spaced at such a distance from each other so that the said wedges will fit into everyother space between the three string unisons of a piano, and a method of using a number of the said muting strips where, in tuning, two of the said muting strips are placed one above the other and offset one unison so that all spaces between the said unisons are muted and after the center string of each is tuned, one outer string of each of the said unisons are tuned, then the remaining said muting strip is shifted over one space and then the remaining outer strings are tuned.

2. A muting strip according to claim 1 where the said wedges have ridges thereon.

* * * * *